United States Patent [19]

Moynihan

[11] Patent Number: 4,892,452

[45] Date of Patent: Jan. 9, 1990

[54] PARKING APPARATUS

[75] Inventor: John J. Moynihan, Newport Beach, Calif.

[73] Assignee: GMX Parking Systems, Santa Ana, Calif.

[21] Appl. No.: 124,828

[22] Filed: Nov. 24, 1987

[51] Int. Cl.[4] ..... E04H 6/06

[52] U.S. Cl. ..... 414/229; 108/7

[58] Field of Search ..... 414/227, 228, 229, 230, 414/234, 235, 252, 678, 719, 369, 372, 579; 901/48; 188/82.3, 92.34, 82.4; 16/84, 332, 334, 344; 219/202, 203, 345; 108/2, 7

[56] References Cited

U.S. PATENT DOCUMENTS

| | | | |
|---|---|---|---|
| 1,793,622 | 2/1931 | Kidder | 414/372 X |
| 2,477,137 | 7/1949 | Mihaler | 188/82.3 |
| 3,351,218 | 11/1967 | Garthoffner | 414/230 |
| 3,387,722 | 6/1968 | Fisher, Sr. et al. . | |
| 3,520,423 | 7/1970 | Gerhardt | 414/229 |
| 3,688,922 | 9/1972 | Klaus | 414/229 |
| 3,706,356 | 12/1972 | Herbst et al. . | |
| 3,750,808 | 8/1973 | Klaus | 414/229 |
| 3,924,760 | 12/1975 | Lendi | 414/229 |
| 4,194,264 | 3/1980 | Stoffregen | 16/84 X |
| 4,382,311 | 5/1983 | Watts | 16/84 X |
| 4,564,745 | 1/1986 | Dexhenes | 219/345 X |
| 4,733,057 | 3/1988 | Stanzel et al. | 219/345 X |

FOREIGN PATENT DOCUMENTS

| | | | |
|---|---|---|---|
| 1170605 | 5/1964 | Fed. Rep. of Germany | 414/227 |
| 1284610 | 12/1968 | Fed. Rep. of Germany . | |

OTHER PUBLICATIONS

C & F Parking Systems: Now You Can *Double* . . . , pp. 1–4.

Duopark Solves Parking Problems, pp. 1–3, Denver Colo.

Park Master Products, Inc.: Double-Deck Parking Creates Valuable Real Estate, pp. 1–2, Fullerton, CA.

The Car Stacker From CSI, p. 1, Fort Worth, Tex.

Space-Maker Quietly Lifts a Car . . . , pp. 1–2, Bergenfield, N.J.

Jerr-Dan Wringler, pp. 1–2, Greencastle, Pa.

*Primary Examiner*—Robert J. Spar

*Assistant Examiner*—Robert S. Katz

*Attorney, Agent, or Firm*—Knobbe, Martens, Olson & Bear

[57] ABSTRACT

A vehicle parking apparatus incorporating a platform and a mounting device. The platform is sized and shaped to permit a vehicle to be driven onto the platform so that it is supported thereby. The platform is supported between its ends by a mounting device in a manner which permits the platform to selectively pivot in response to the force of gravity on the platform and any additional items supported thereby.

28 Claims, 7 Drawing Sheets

19
31
33
35
37
39
41
43
45
46
47
49
51
53
55
57

Fig. 6
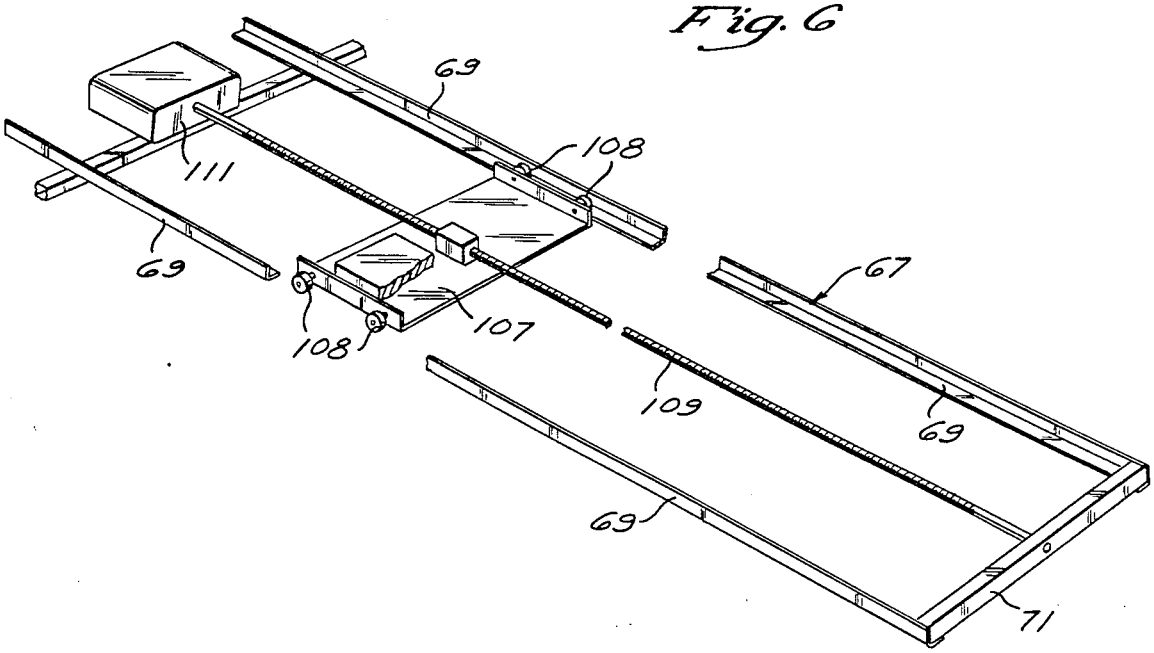
Fig. 7
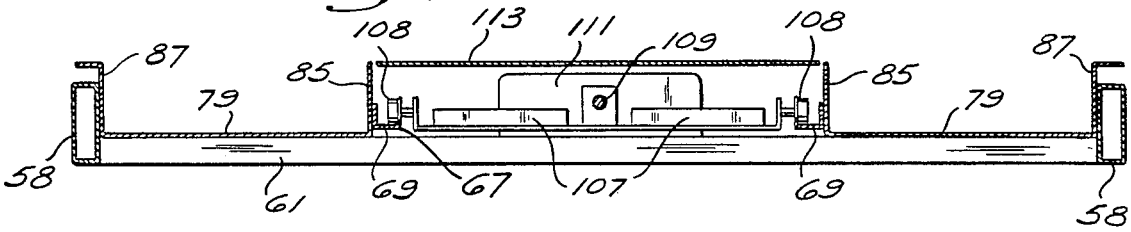
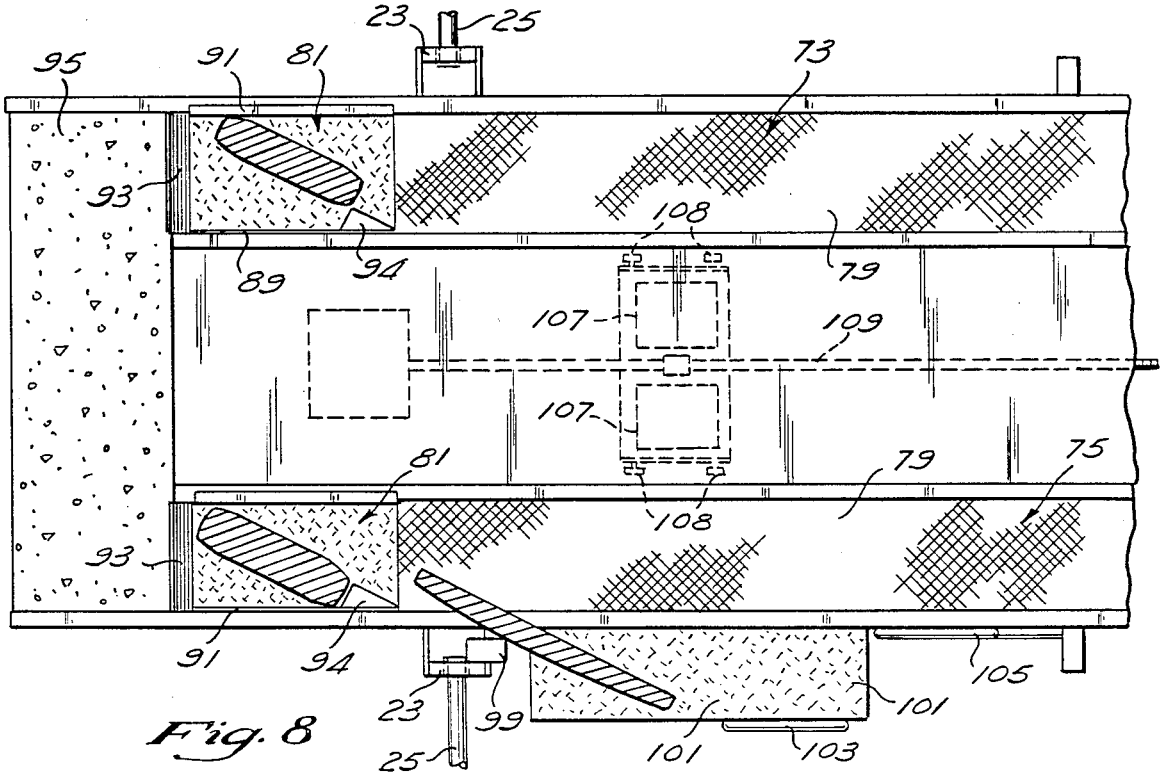
Fig. 8

PARKING APPARATUS

BACKGROUND OF THE INVENTION

This invention relates to apparatus and a method for parking automobiles and other vehicles in vertically arranged pairs.

In many settings, the cost of real estate and shortages of space make necessary the efficient utilization of whatever parking area is available. One approach to making more efficient use of parking space has been to stack the autos in vertically arranged pairs.

The devices utilized for stacking autos have generally incorporated powerful mechanical and/or hydraulic lifts to raise the upper vehicle. As these lifts typically add significantly to the overall cost of the stacking apparatus, an improved parking apparatus is needed in which the need for powerful lifts is obviated.

SUMMARY OF THE INVENTION

The invention includes a vehicle parking apparatus incorporating a platform and a mounting device. The platform is sized and shaped to permit a vehicle to be driven onto and supported by the platform. The platform is supported between its ends by a mounting device in a manner which permits the platform to selectively pivot in response to the force of gravity on the platform and any additional items supported thereby. In one position of the platform a vehicle can be driven onto the platform. In a second position the platform and vehicle are pivoted to allow a second vehicle to be driven beneath the platform, to thus maximize storage.

Advantageously, the platform is suspended from the mounting device to place the center of gravity of the load supported by the platform near the rotational axis, thereby decreasing the net rotational force on the platform from the force of gravity on the load. The apparatus desirably includes a weight shifter supported by the platform for selectively changing the distribution of weight supported by the platform to permit the direction in which the platform has a tendency to pivot to be controlled. The apparatus includes means to limit the forward pivoting of the platform when moved to its second position.

Another aspect of the invention is a method of parking a vehicle including the steps of driving the vehicle onto an inclined platform and changing the distribution of weight supported by the platform to cause the platform to pivot in response to the force of gravity. Advantageously, the distribution of weight supported by the platform can be changed by moving a weight along the length of the platform.

DESCRIPTION OF THE DRAWINGS

These and other features of the invention will now be described with reference to the drawings of a preferred embodiment adapted for use with automobiles, which is intended to illustrate, and not to limit, the invention, and in which:

FIG. 6 is a cutaway partial perspective view illustrating the load manager of the apparatus of FIG. 1;

FIG. 7 is a partial sectional view illustrating placement of the load manager with respect to the platform of the apparatus of FIG. 1;

FIG. 8 is a plan view illustrating the position of the tires and door of a vehicle supported on the platform of the apparatus of FIG. 1;

DETAILED DESCRIPTION

Figure 1:
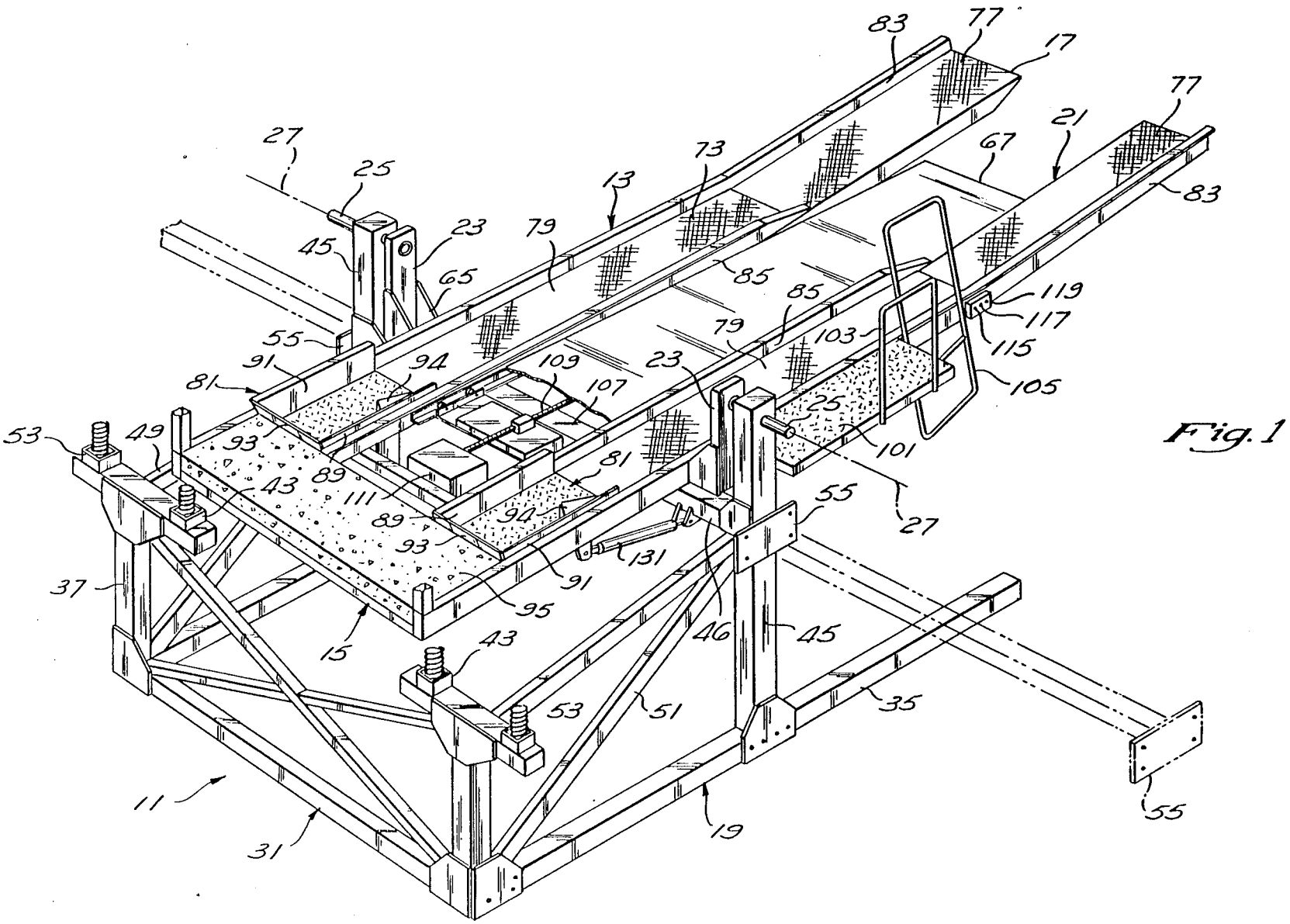
FIG. 1 is a perspective view of the parking apparatus of the present invention.

Referring to FIG. 1, there is shown an automobile parking apparatus 11 incorporating an elongate platform 13 supported between its ends, 15 and 17, by a mounting device 19 or fulcrum. The platform 13 includes a relatively flat base 21 for supporting and retaining an automobile and a pair of arms 23 which extend perpendicularly upward from the base 21. A pair of coaxial horizontal shafts 25 are secured to respective arms 23 of the platform 13 and extend through mating apertures in posts 45 of the mounting device 19. Advantageously, these apertures are provided with greased fittings or ball bearings which permit the free rotation of the shafts 25 relative the mounting device 19. Thus supported, the platform 13 will rotate or pivot about the axis 27 of the shafts 25 until the countervailing moments exerted on the platform 13 about the axis 27 are in balance with one another.

Countervailing moments about the axis 27 arise due to the force of gravity both on the platform 13 and loads supported thereby. The countervailing moments about the axis 27 due to the platform 13 are caused by the force of gravity on the respective portions of the platform 13 located on opposite sides of a line intersecting the axis 27 of the shafts 25 in the direction of the force of gravity. The magnitude of the countervailing moments due to the force of gravity on the respective portions of the platform 13 vary in direct proportion to the force of gravity on the respective portion and the length of the moment arm (i.e., the perpendicular distance between the line intersecting the axis of the shafts 25 in the direction of the force of gravity and the line intersecting the center of gravity of the portion in the direction of the force of gravity) between the axis 27 and the center of gravity of the portion. Additional countervailing moments will arise from the force of gravity on the load (e.g., an automobile) supported by the platform 13.

As it is desirable for the platform 13 to pivot slowly, it is desirable to minimize the magnitude of the net moment about the axis 27 due to the force of gravity on the load. This can be done by aligning the axis 27 of the shafts 25 vertically and horizontally with the center of gravity of the vehicle. In applications where different types of vehicles are to be parked on the same apparatus 11, this will not be possible. In these situations, it is desirable that the arms 23 be positioned horizontally along the base 21 to approximate the weighted average horizontal position of the center of gravity of the class of vehicle to be parked. Likewise, it is desirable that the vertical distance between the base 21 and the axis 27 of the shafts 25 approximate the weighted average vertical distance of the center of gravity of the class of vehicle from the driving surface, ordinarily, about 16–18 inches. The average position of the center of gravity is weighted to take into account the greater difficulty of counterbalancing the weight of heavier vehicles when the axis 27 of the shafts 25 is not aligned with the center of gravity of the vehicle.

Figure 13:
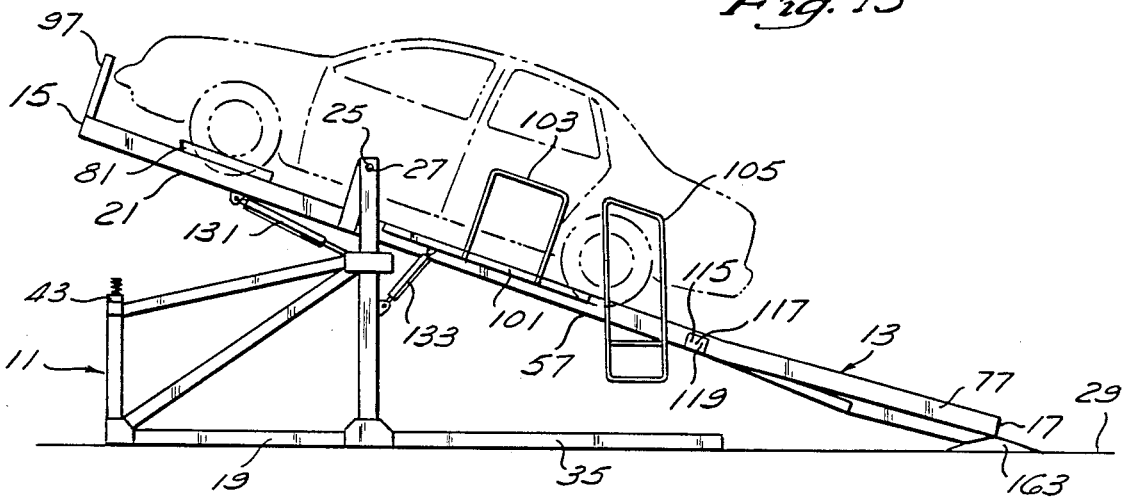
FIG. 13 is an elevational view illustrating the apparatus of FIG. 1 in its lowered position, with the position of an auto shown in phantom.
Figure 14:
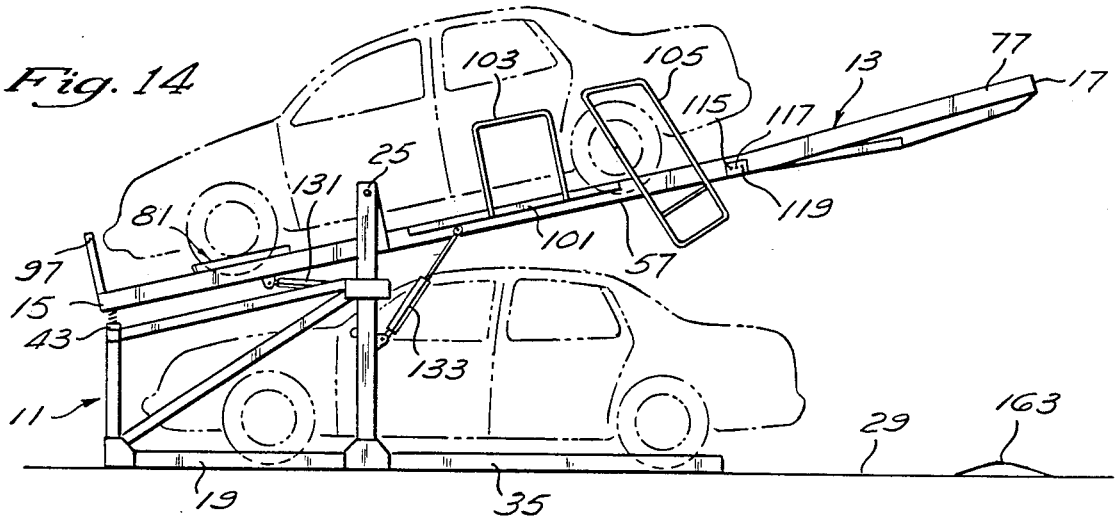
FIG. 14 is an elevational view illustrating the apparatus of FIG. 1 in its raised position, with the positions of an upper and lower auto shown in phantom.

The rearward or, as shown in FIG. 13, clockwise rotation of the platform 13 is limited by the force exerted on the open end 17 of the platform 13 by the surface 29 upon which the apparatus 11 rests. Likewise, the forward or, as shown in FIG. 14, counterclockwise rotation of the platform 13 is limited by the force exerted on the closed end 15 of the platform 13 by the mounting device 19.

The Mounting Device

Figures 2, 3:
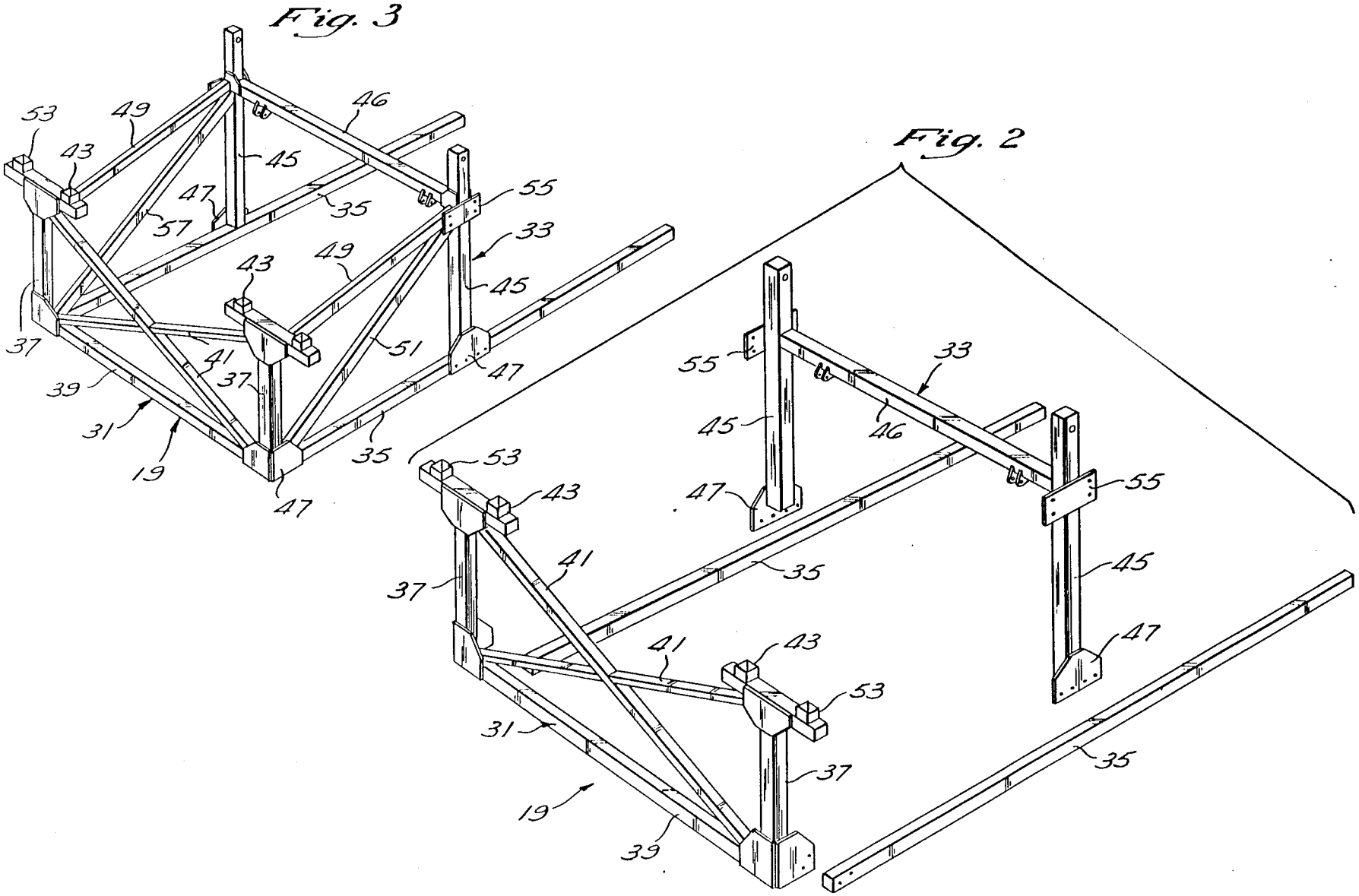
FIG. 2 is an exploded perspective view illustrating the frame of the mounting device of the apparatus of FIG. 1.
FIG. 3 is a perspective view illustrating the assembled frame of FIG. 2.

As shown in FIG. 2, the mounting device 19 incorporates an end support 31 and a mid support 33 secured together by a pair of elongate base members 35. The end support 31 includes a pair of vertical corner supports 37 joined by a horizontal connecting member 39 and a pair of overlapping diagonal braces 41. When assembled, the corner supports 37 and the horizontal connecting member 39, and the horizontal connecting member 39 and the base members 35 form respective open ended rectangles. Secured to the top of each corner support 37 is a platform stop 43 extending inward from the corner supports 37 to limit the forward rotation of the platform 13 about the axis 27 of the shafts 25. As best seen in FIG. 1, these stops 43 can be provided with helical springs to absorb the impact of the platform 13 against the stops.

Referring again to FIG. 2, the generally H-shaped mid support 33 is formed by the pair of vertical side supports or posts 45 connected by a horizontal member 46 positioned approximately one-third of the way from the top of the posts 45. The end support 31 and the mid support 33 can be pre-welded prior to assembly of the apparatus 11 and are preferably provided with flanges 47 which permit them to be bolted to the base members 35 at the parking site. As shown in FIG. 3, additional upper and lower bracing members, 49 and 51, can be provided between the end and mid supports.

Advantageously, the mounting device 19 is adapted to cooperate with additional mounting devices to support a series of platforms side-by-side in series. As shown in FIG. 1, the end support 31 can be provided with a second forward stop 53 extending horizontally from the top of each corner member, and the posts 45 of the mid support 33 can be provided with a plate 55 opposite the horizontal member to which a specially-adapted horizontal member may be bolted. As shown in phantom in FIG. 1, these specially-adapted horizontal members are provided with end support plates which can be bolted to the plates of the posts 45. As also shown in FIG. 1, the shafts 25 may extend through the posts 45 opposite the platform 13 to permit an additional arm to be supported by each shaft 25. This permits a single mounting device 19 to fully support a platform 13 located between its posts 45 and to partially support each of two platforms located outside of its posts 45.

Alternatively, the posts 45 could be provided with sleeves instead of plates 55 for supporting a generally U-shaped mounting device. The mounting device could include two partial vertical posts and a pair of inwardly extending shafts for supporting a platform. Advantageously, the sleeves would permit the height of the mounting device to be adjusted to compensate for variations in the level of the surface 29.

The Platform

Figures 4, 5:
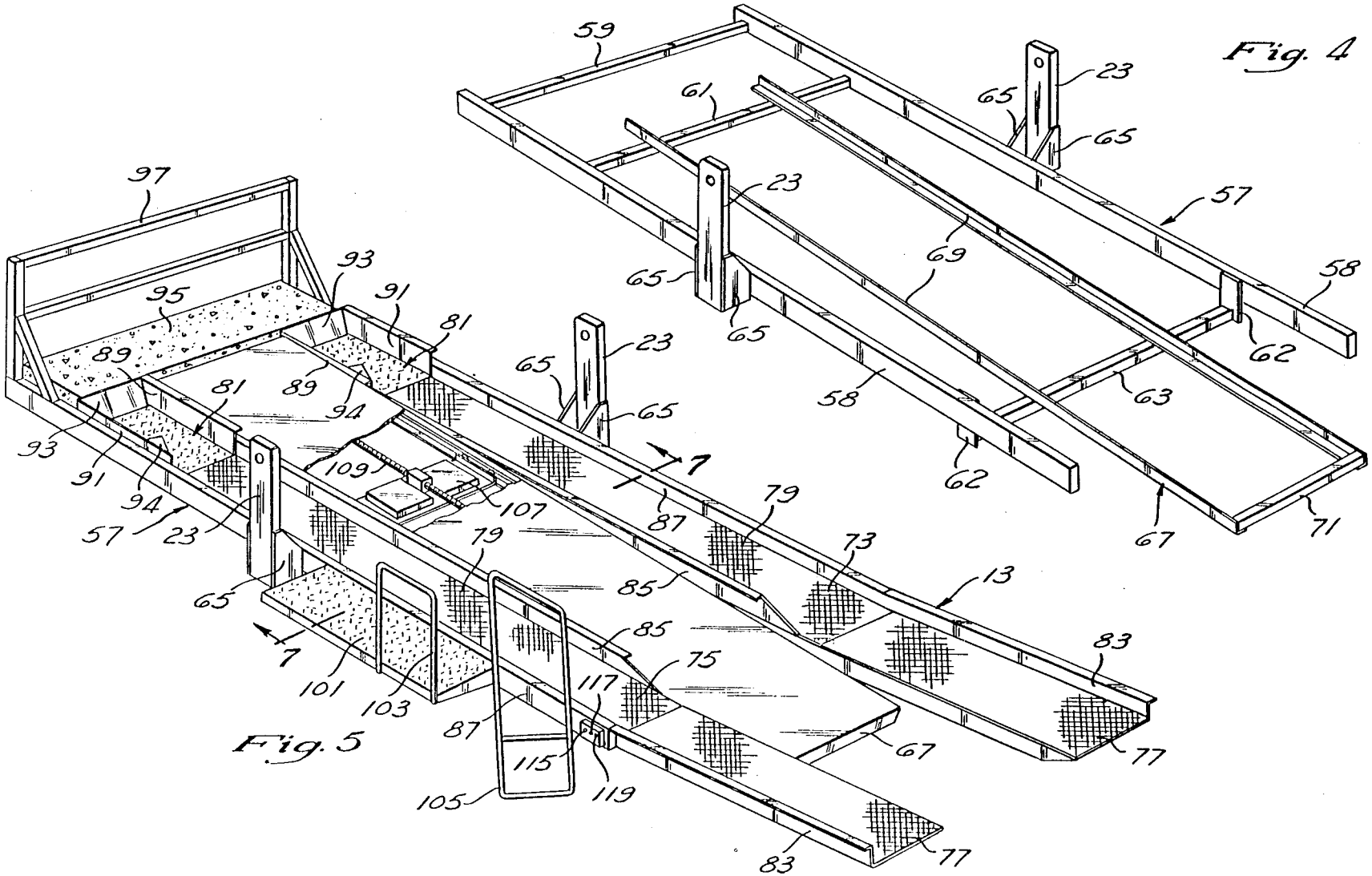
FIG. 4 is a perspective view of the frame of the platform of the apparatus of FIG. 1.
FIG. 5 is a perspective view of the base and arms of the platform of the apparatus of FIG. 1.

Referring now to FIG. 4, the platform base 21 (FIG. 1) incorporates a generally rectangular frame 57 comprised of two elongate members 58 secured together by three connecting members, 59, 61, and 63. Each of the platform's pair of arms 23 is secured midway along the outer edge of the elongate members 58 by a pair of spacing flanges 65. Two connecting members 59 and 61, are located at the front of the platform 13 and are positioned relatively closely to one another. A third depending connecting member 63 is located near the rear of the platform 13 and is connected to the elongate members 58 by means of a pair of depending flanges 62. The rear two connecting members 61 and 63, provide a support for an inclined track 67 comprised of two parallel angles 69 connected at one end by a blocking bar 71. The track 67 extends from between the front pair of connecting members 59 and 61, past the depending connecting member 63 and beyond the end of the frame 57.

Referring now to FIG. 5, a pair of horizontal troughs, 73 and 75, are nested between the track 67 (FIG. 4) and the elongate members of the frame 57 on top of the rear two connecting members 61 and 63 (FIG. 4). Advantageously, the troughs, 73 and 75, include a pre-ramp 77, a main ramp 79 and a tire lock pan 81. The pre-ramp 77 section is provided with raised outer walls 83 which guide the tires of the vehicle onto the platform 13, but is otherwise flat to provide sufficient room to permit the vehicle tires to enter the pre-ramp 77 at an angle. The pre-ramp 77 is tapered upward slightly from the main ramp 79 to prevent the front of the vehicle from scraping the ramp, and is tapered along the bottom to provide a flat support for the platform 13 in its fully lowered position.

The main ramp 79, in contrast, is provided with interior and exterior walls, 85 and 87, to securely retain the vehicle tires on the platform 13. Both the pre-ramp 77 and the main ramp 79 are preferably covered with expanded metal to provide a slip-free surface for the automobile tires when the ramp is in an inclined position. The expanded metal covering provides the additional advantage of permitting the unobstructed draining of dirt, water and oil from the troughs, 73 and 75. In cold weather climates, electric heating devices can be provided beneath the expanded metal covering to prevent snow and ice from building up on the ramps.

As seen in FIG. 5, the tire lock pan 81 includes tall interior and exterior walls, 89 and 91, connected by a forward wall 93 which acts as a stop to prevent the vehicle from rolling off the platform 13. As best seen in FIG. 8, the tire lock pans 81 include a pair of triangular blocks 94 jutting from the rear left-hand edge of the pan which are small enough to provide sufficient space for the automobile tires to easily pass into the pans, but are large enough to prevent the tire from rolling out of the pans when the tires are turned to the right. The transition between the main ramp 79 and the tire lock pan 81 may be stepped to form a bump to provide the operator of the vehicle with an indication that the vehicle tires have entered the tire lock pan. The tire lock pan 81 is preferably covered with 4-way grip plate, which provides traction, but permits the rotation of the tires without damage.

As shown in FIG. 13, the portion of the platform 13 to the rear of the shafts 25 is significantly longer than the portion of the platform to the front of the shafts. This minimizes the grade which the vehicle must climb when driving onto the platform in its lowered position.

It is desirable that the platform 13 be balanced about the axis 27 (FIG. 1) of the shafts 25 to minimize the amount of force necessary to rotate the platform in either direction. This will permit the platform to be pivoted manually in the event of a power failure. To counteract the greater bulk of the platform positioned rearward of the axis of the shafts, a fixed weight 95 (FIG. 1) is positioned at the front of the platform. Since the weight is located at the front of the platform, the moment arm of the force of gravity acting on the weight 95 is maximized, therefore minimizing the mass of the weight 95 necessary to counteract the moment created by the rearward portion of the platform.

A vertical rail 97 at the front end of the platform 13 performs the dual role of providing a visible indication of the end of the platform 13 for the driver of a vehicle and forming a physical barrier to prevent the vehicle from being driven off the platform.

As shown in FIG. 8, the inside face of the platform's left side arm 23 is provided with a protective pad 99 to prevent the driver's door from being damaged when the door is opened. An outwardly extending horizontal plate or running board 101 is located slightly rearward of the platform's left side arm 23 and provides a convenient platform on which the exiting operator may stand. A raised hand railing 103 is provided along the rear side edge of the running board 101 for the operator to grasp before descending a short step ladder 105 secured along the outer edge of the frame 57 immediately behind the running board 101.

The Load Manager

Referring to FIG. 5, a load manager 107 or weight shifter is positioned between the troughs, 73 and 75, and is supported by the track 67 (FIG. 4). The load manager 107 travels along the length of the platform 13 from a point slightly above the platform 13 frame 57 near the tire lock pans 81 to a point approximately four inches below the frame 57 near the pre-ramp 77, out of the way of low hanging fog lights and license plates. As shown in FIGS. 6 and 7, the load manager 107 preferably comprises a weighted trolley having four wheels 108 and is adapted to be propelled along the length of the track 67 by means of a screw drive 109 driven by a motor 111 of fractional horsepower. The motor 111 and screw drive 109 are comparable to those presently used in electric garage door openers.

The load manager provides an efficient and reliable device for pivoting the platform 13 of the apparatus in the desired direction. For example, by moving a load manager of approximately 200 pounds along the length of the platform seven feet, well over 1,000 foot pounds of rotational force will be applied to the platform.

When the apparatus 11 is constructed so that the axis 27 of the shafts 25 intersects the center of gravity of the vehicle supported by the platform 13, the platform may be pivoted by moving the load manager 107 a short distance forward or rearward of the line including the axis 27 in the direction of the force of gravity. When the apparatus is to be used in connection with various types of vehicles, it is desirable that the axis 27 of the shafts 25 be positioned so the center of gravity of the vehicles is located forward of the line intersecting the axis of the shafts in the direction of the force of gravity. The reason for this is when a forward rotational moment is created by the weight of the vehicle located forward of the shafts, the load manager can create a relatively large counterbalancing moment by moving far rearward of the shaft. However, if the center of gravity of the vehicle were located rearward of the shafts, the load manager would not be able to create as large a counterbalancing moment due to the shorter length of the track forward of the shafts.

Furthermore, when the apparatus 11 is to be used with a variety of vehicles, it is desirable that the axis of the shafts 25 be positioned rearward, but very close to the center of gravity of the longer vehicles. Although the center of gravity of smaller cars will then be located farther from the axis, since the shorter cars are typically lighter, generally less rotational force is necessary to overcome the effect of this moment arm than would be necessary with a longer, heavier vehicle.

The small motor 111 and inclined track 67 of the load manager 107 ensure that a maximum of space is available for the automobiles parked above and/or below the platform 13. As best seen in FIG. 7, the load manager 107 is covered with a shield 113 to prevent dirt and oil from falling onto the track 67 or a vehicle parked below the platform 13.

Referring to FIG. 1, the load manager 107 is controlled by means of a series of switches located slightly rearward of the step ladder 105 along the outer edge of the elongate member of the frame 57. A forward switch 115 causes the load manager 107 to be propelled towards the front of the parking apparatus 11, a stop switch 117 stops all movement of the load manager 107 relative the track 67, and a rearward switch 119 causes the motor 111 to propel load manager 107 towards the rear of the track 67. In another embodiment of the invention, the switches may be supplemented with a radio control device which permits the platform to be rotated from within the passenger compartment of the vehicle.

Figure 12:
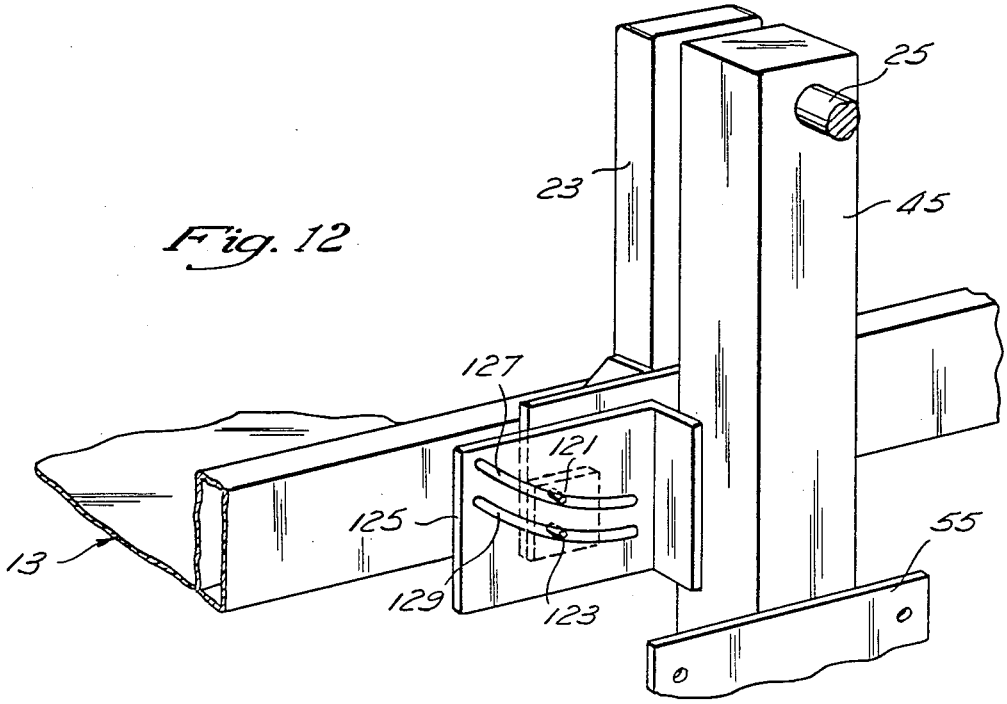
FIG. 12 illustrates a pair of automatic cutoff switches and mating plate for the weight shifter of FIG. 1.
Figure 15:
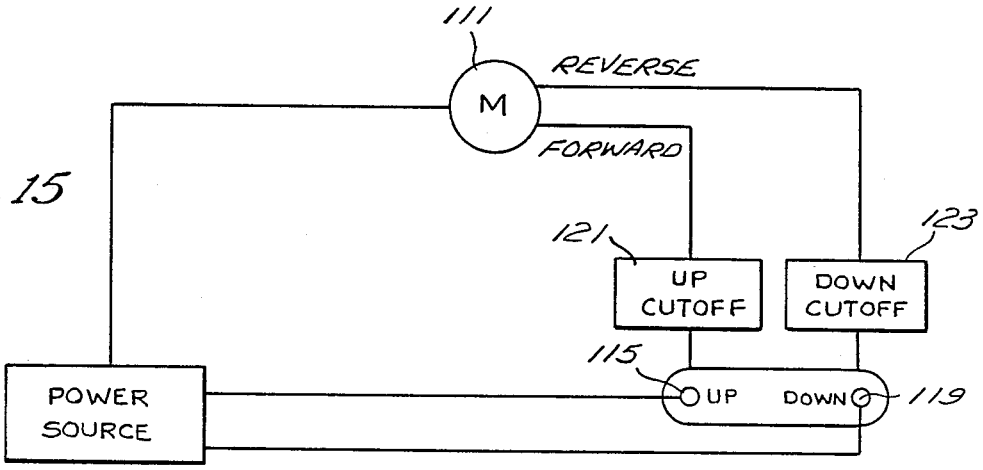
FIG. 15 is a schematic view of the electrical circuit of the automatic cutoff switch of FIG. 12.

Referring now to FIGS. 12 and 15, a pair of automatic cutoff switches, 121 and 123, and a grooved plate 125 formed to mate with the switches may be provided to selectively control the actuation of the load manager 107 in response to the rotation of the platform 13 relative the mounting device 19. The switches slide in a pair of grooves, 127 and 129, formed in the plate 125 which conform to the location of the switches throughout the rotation of the platform 13. Where the grooves are deep enough to allow the switches to assume an undepressed state, the switches prevent the flow of electricity from the power source to the electrical motor 111 of the load manager 107. Where the grooves are shallow enough that the plate depresses switches, the switches permit the free flow of electricity from the power source to the motor 111.

The groove in which the up cutoff switch 121 slides depresses the up cutoff switch 121 when the platform 13 is in its fully lowered position (as illustrated in FIG. 13). When the up switch is activated, the motor 111 propels the load manager 107 towards the front of the track 67 until the shift in the distribution of weight creates a moment sufficient to cause the platform 13 to begin to rotate forward. As the platform 13 rotates, the switch 121 slides forward in its groove to a point where the groove is deep enough to permit the switch to return to its undepressed state, which cuts off the power to the electric motor 111 and stops the movement of the weighted trolley towards the front of the track 67. This in turn limits the increase in magnitude of the moment about the axis 27 due to the force of gravity on the load manager 107 by limiting the length of the moment arm to which the force is applied. Therefore, by cutting off the power at the proper point, the cutoff switch can be used to ensure that the platform 13 settles softly against the platform stops 43.

When the platform 13 is in its fully raised position (as illustrated in FIG. 14), the depth of the groove is such that the switch is depressed and power is permitted to flow from the power source to the electric motor 111. When the down switch 123 is depressed, the motor 111 propels the load manager 107 towards the rear of the platform 13 eventually causing the platform 13 to rotate downward. This in turn causes the switch to slide rearward in its groove 129 to a point where the groove is deeper, permitting the cutoff switch to be released and stopping the movement of the trolley along the track 67. As with the up switch, by forming the groove 129 in relation to the weight of the automobile to be parked, the power can be cut off at a point which will result in the soft settling down of the rear end 17 of the platform 13 on the support surface 29. At the rear extreme of the rotation, the groove again is shallow enough to depress the down cutoff switch so that power is permitted to flow from the power source to the motor 111, causing the trolley to be propelled to the rear-most end of the track 67. This protects against the platform 13 rotating rapidly upward when a vehicle is driven up the platform 13.

Safety Features

The parking apparatus 11 is desirably provided with a number of safety features. As shown in FIGS. 1 and 13, these include a front and a rear pair of shock absorbers, 131 and 133. The front pair of shock absorbers 131 may be secured to the horizontal member 46 (FIG. 1) of the mid support 33 and the bottom of the elongate members 58 of the platform frame 57 near the tire lock pans 81. The rear pair of shock absorbers 133 may be secured to the rear vertical face of the side members and the base 21 of the elongate members of the platform frame 57 near the running board 101.

Figure 11:
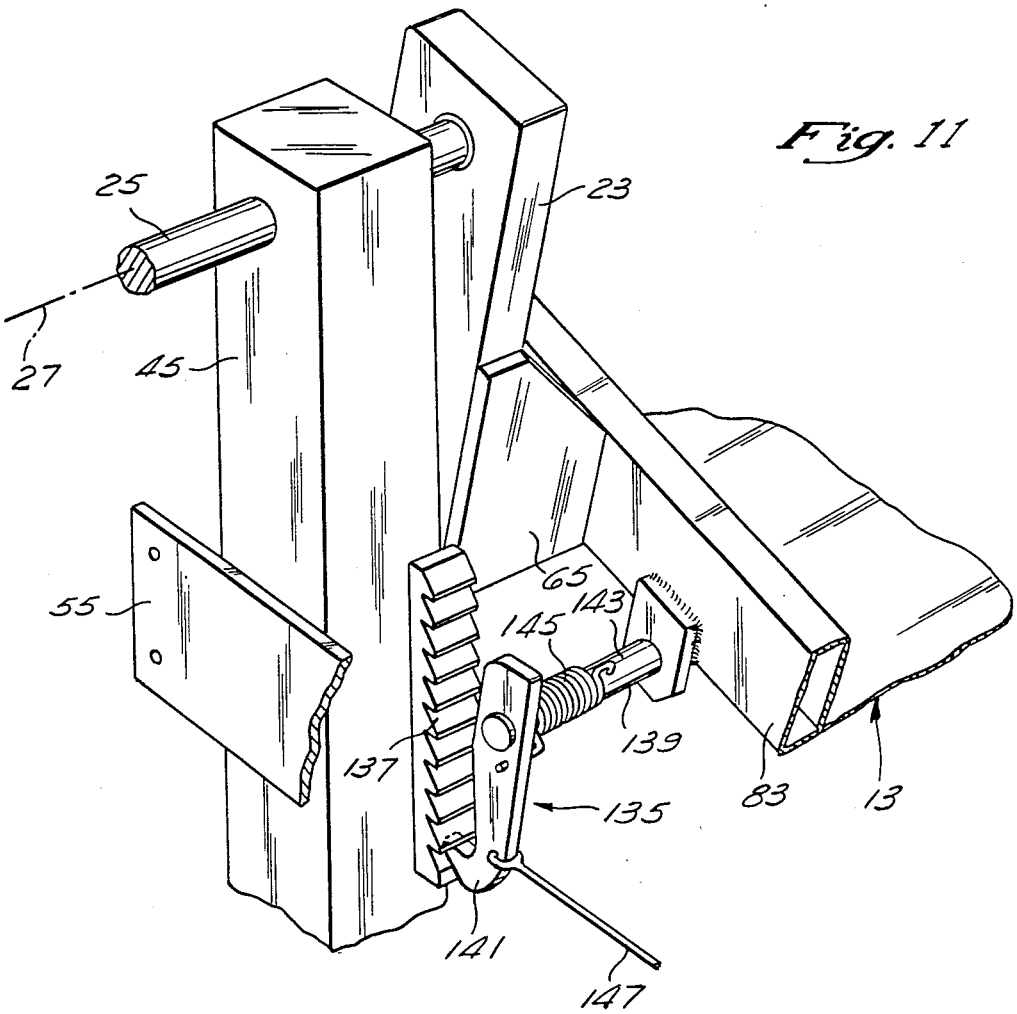
FIG. 11 is an enlarged partial perspective view illustrating a safety locking mechanism utilized by the device of FIG. 1.

Referring now to FIG. 11, an additional safety feature is a rack 137 and hook mechanism 139 for preventing the rotation of the platform 13 relative the mounting device 19. The mechanism 135 includes a rack 137 secured to the rear vertical face of the left side support and a hook mechanism 139 secured to the outer face of the elongate member of the platform frame 57. The hook mechanism 139 is formed by a hook 141 which is rotatably secured to a cylindrical pin 143 which is in turn fixed to an elongate member of the frame 57. A tensioned helical spring 145 biases the hook into engagement with the rack 137. This prevents the platform 13 from rotating about the axis 27 of the mounting device 19 unless sufficient force is applied to a cable 147 secured to the hook 141 to overcome the bias of the spring 145. Additional hook and rack mechanisms may be utilized to further ensure that the movement of the platform 13 relative the mounting device 19 is prevented.

Alternative Tire Block

Figure 9:
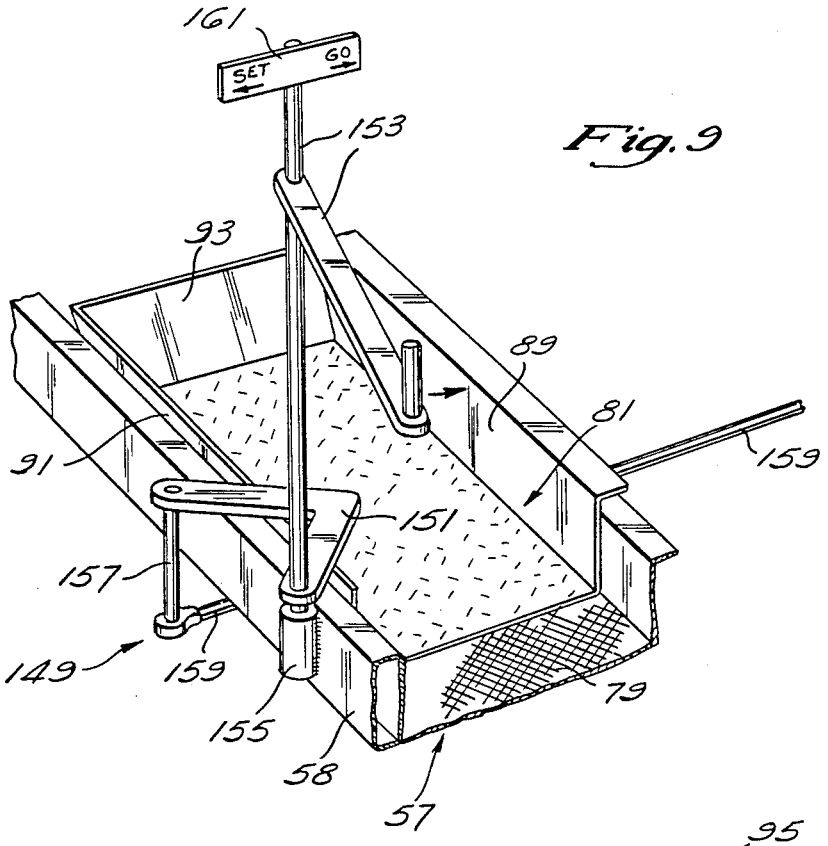
FIG. 9 is a alternative embodiment of a tire block mechanism.
Figure 10:
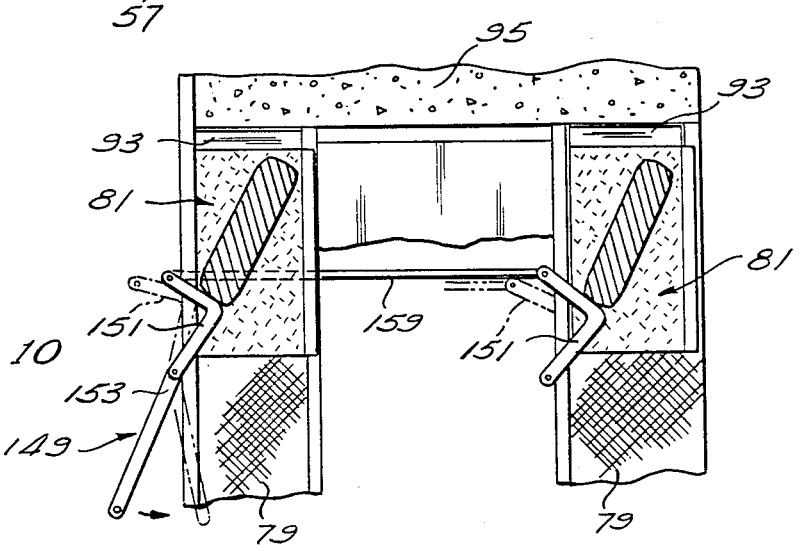
FIG. 10 is a partial plan view illustrating a pair of the tire block mechanisms as illustrated in FIG. 9.

Referring now to FIGS. 9 and 10, there is shown an alternative embodiment of the tire block of the present invention. Due to the different sizes of tires utilized by automobiles, in some applications it will be desirable to be able to utilize an adjustable tire block 149. The tire block 149 may comprise a generally L-shaped bar 151 fixed to a cylindrical rod 153 which is rotatably secured to the platform frame 57 by a cup-shaped cylinder 155. Advantageously, this L-shaped bar 151 is connected by a pair of vertical linkages 157 and a horizontal linkage 159 to a second L-shaped rod 153 secured to the inside of the right tire lock pan 81.

The operator sets the tire block 149 by driving the automobile against the front of the tire lock pans 81, turning the tire to the right and pushing a lever secured to the shaft to the left, thereby forcing the bars 151 against the rear of the front tires. The tire lock may later be released by simply inching the car forward and pulling the lever to the right, thereby rotating the bars out of the way of the tires. As a reminder to the operator as to which direction to push the lever, a directional plate 161 may be placed upon the shaft indicating the proper direction for the lever to be moved to achieve the desired result.

Operation

Referring now to FIG. 13, the operation of the automobile parking apparatus 11 will be briefly described. Before an auto is driven onto the platform 13, the trolley or load manager 107 (FIG. 5) is propelled to the rear of the track 67 (FIG. 4) adjacent the blocking bar 71 (FIG. 4). This causes the platform 13 to rotate so that the tapered bottom of the pre-ramp 77 rests firmly against a mating mini-ramp 163 the garage floor. The automobile is then driven onto the platform 13 and up the troughs, 73 and 75 (FIG. 5), until the front tires of the automobile slowly strike the forward wall 93 (FIG. 5) of the tire lock pans 81, as shown in FIG. 13. The front tires of the vehicle are then turned to the right and the vehicle is allowed to roll back slightly so that the tires rest firmly against the tire blocks 94, as shown in FIG. 8. The automobile is then exited by means of opening the driver's door and stepping out onto the running board 101 and down the step ladder 105. Because the movement of the driver's door is limited by the padded arm 23 (FIG. 8), the driver is prevented from stepping over the running board 101 and falling.

Once the driver has exited the vehicle and has shut the vehicle door, the restraints on the rotation of the platform 13 are released and the forward switch 115 of the load manager is depressed so that the trolley will move toward the front of the track 67 (FIG. 6). Due to the relatively slow movement of the trolley's screw drive 109 (FIG. 6), the forward rotation of the platform 13 will take place gradually until the rotation is limited by the forward platform stops 43. The platform 13 rotation restraining devices can then be reapplied to prevent inadvertent rotation of the platform 13. As shown in FIG. 14, the stops prevent the forward rotation of the platform at a point where the forward end of the platform is significantly lower than the rear end of the platform. Since most automobiles have a short hood or engine compartment before the passenger compartment, most automobiles can be readily parked in the space formed below the platform of the parking apparatus. In addition, since the raised rear end of the platform extends above the roof height of most vehicles the space behind the lower automobile yet beneath the platform may be used as an aisle way between rows of parking apparatus.

When it is desired to move the upper automobile, the lower automobile is moved from beneath the platform 13. The platform 13 rotation restraining devices are then released and the rear load manager switch 119 is depressed. As the load manager 107 moves toward the rear of the platform 13, the platform 13 will gradually rotate rearward until the bottom edge of the platform 13 rests against the support surface 29 shown in FIG. 13. Next, the platform 13 rotation restraining devices are reapplied and the operator steps up the ladder 105 onto the running board 101 and into the driver's door. The automobile is then inched slightly forward to remove the pressure of the blocks 94 on the front tires. The tires can then be rotated to the left and the automobile backed down the platform 13.

The invention thus provides a safe, simple and economical vehicle parking apparatus without the powerful lifts or complicated hydraulics of previous designs.

It is understood, however, that instead of a second vehicle, the space beneath the platform of the present invention could be used as a storage area for non-vehicles. In addition, it is clear that the principles of the present invention are not limited to a vehicle parking apparatus, as the platform could be used to support stationary objects.

I claim:

1. A vehicle parking apparatus, comprising:

a platform having a base and a pair of arms, said base being sized and shaped to permit a vehicle to be driven onto said base and be supported thereby, said base having a first end and a second end and said arms secured to and extending upward from said base between said ends;

a mounting device suspending said platform by said arms in a manner which permits said platform to selectively rotate about an axis in response to the force of gravity on the platform and any additional items supported thereby; and a weight shifter supported by said platform for selectively shifting the center of gravity of the weight borne by said platform from one side of a line intersecting said axis in the direction of the force of gravity to the opposite side of said line without changing the position of said vehicle relative to said platform to permit the direction in which said platform has a tendency to rotate to be controlled.

2. The vehicle parking apparatus of claim 1, wherein said second end of said base is shaped to permit a vehicle to be driven onto it, and the distance between said second end and said arms is significantly longer that the distance between said arms and said first end, further comprising a fixed weight supported between said arms and said first end to offset the moment of force on said platform due to the force of gravity on the portion of said platform between said arms and said second end.

3. The vehicle parking apparatus of claim 1, wherein said mounting device further comprises means for partially supporting additional adjacent platforms.

4. The vehicle parking apparatus of claim 1, further comprising means to limit the forward rotation of said platform.

5. The vehicle parking apparatus of claim 4, further comprising means to slow the rotation of said platform relative said mounting device.

6. The vehicle parking apparatus of claim 4, further comprising means to prevent the rotation of said platform relative said mounting device.

7. The vehicle parking apparatus of claim 4, wherein at said limit of said forward rotation said apparatus forms a space below said platform, wherein a vehicle may be parked.

8. An apparatus, comprising:

a mounting device;

a platform sized and shaped to permit a vehicle to be driven onto said platform and be supported thereby, said platform having a first end and a second end and being supported by said mounting device between said ends in a manner which permits said platform to selectively rotate about an axis in response to the force of gravity on the platform and any additional items supported thereby; and a weight shifter supported by said platform for selectively shifting the center of gravity of the weight borne by said platform from one side of a line intersecting said axis in the direction of the force gravity to the opposite side of said line without changing the position of said vehicle relative to said platform to permit the direction in which said platform has a tendency to rotate to be controlled.

9. The apparatus of claim 8, further comprising means to limit the forward rotation of said platform.

10. The apparatus of claim 9, further comprising means to slow the rotation of said platform relative said mounting device.

11. The apparatus of claim 9, wherein at said limit of said forward rotation, said device forms a space below said platform, wherein a vehicle may be parked.

12. The apparatus of claim 11, wherein said platform is suspended from said mounting device.

13. The apparatus of claim 12, wherein said platform further comprises a pair of raised arms, and said mounting device further comprises a pair of shafts about which said arms rotate.

14. The apparatus of claim 11, further comprising means for fixing the position of said vehicle relative said platform.

15. The apparatus of claim 14, wherein said fixing means is adjustable.

16. The apparatus of claim 11, further comprising means to heat said platform to melt ice thereon.

17. The vehicle parking apparatus of claim 8, wherein said weight shifter is movable at least part of the way between said ends of said platform.

18. A vehicle parking apparatus, comprising:

a platform sized and shaped to permit a vehicle to be driven onto said platform and be supported thereby, said platform having a first end and a second end;

a mounting device supporting said platform between said ends in a manner which permits said platform to selectively rotate in response to the force of gravity on the platform and any additional items supported thereby;

a weight shifter supported by said platform for selectively changing the distribution of weight supported by said platform to permit the direction in which said platform has a tendency to rotate to be controlled; and means for automatically actuating said weight shifter in response to the rotation of said platform relative said mounting device.

19. A vehicle parking apparatus, comprising:

a platform sized and shaped to permit a vehicle to be driven onto said platform and be supported thereby, said platform having a first end and a second end;

a mounting device supporting said platform between said ends in a manner which permits said platform to selectively rotate in response to the force of gravity on the platform and any additional items supported thereby;

a weight shifter supported by said platform for selectively changing the distribution of weight supported by said platform to permit the direction in which said platform has a tendency to rotate to be controlled; and a motor for moving said weight shifter along the length of said platform and means for automatically controlling the flow of power to said motor in response to the rotation of said platform relative to said mounting device.

20. A vehicle parking apparatus, comprising:

a platform sized and shaped to permit a vehicle to be driven onto said platform and be supported thereby, said platform having a forward end and a rearward end;

a mounting device supporting said platform between said ends in a manner which permits said platform to be pivoted from a first position wherein a vehicle may be driven onto or off of the rear end of said platform to a second position wherein said forward end is pivoted downwardly and said rear end is raised to permit a second vehicle to be driven beneath said platform; and a movable weight shifter supported by said platform for selectively changing the distribution of weight supported by said platform to permit the direction in which said platform has a tendency to rotate to be controlled without changing the position of said vehicle relative to said platform.

21. The vehicle parking apparatus of claim 20, wherein said weight shifter is movable at least part of the way between said ends of said platform.

22. The apparatus of claim 21 wherein, said platform is supported at a height to permit the forward portion of said second vehicle to be driven beneath said platform when said platform is in said second position.

23. A vehicle parking apparatus, comprising:

a fulcrum;

a platform supported by and rotatable about said fulcrum having one portion on one side of said fulcrum and another portion on the opposite side of said fulcrum, wherein a vehicle may be driven onto and supported by said platform; and a weight shifter capable of shifting the center of gravity of the weight borne by said fulcrum from one of said sides of said fulcrum to the opposite side of said fulcrum without changing the position of said vehicle relative to said platform.

24. The vehicle parking device of claim 23, wherein said weight shifter permits the position of said center of gravity of the weight borne by said fulcrum to be selectably adjusted over a range of positions.

25. A vehicle parking apparatus, comprising:

a pair of spaced posts;

a ramp pivotably mounted on said posts, the ramp being shaped for receiving a vehicle, the ramp being pivotable from a load position wherein a rear end of the ramp is lowered so a vehicle can be driven onto the ramp to a storage position wherein the rear end of the ramp and the vehicle are raised sufficiently to permit a second vehicle to be driven beneath the ramp and stored; and a load manager movable at least partway between the ends of said ramp for changing the distribution of weight supported by said ramp.

26. An apparatus, comprising:

a platform having a first end and a second end;

a support for pivotably supporting said platform;

a weight supported by said platform; and means for moving said weight at least part of the way between said ends of said platform to control the pivoting of said platform from a first position wherein a load separate from said weight is moved onto the platform to a second position wherein the platform with its load is raised so as to permit a second load to be moved beneath said platform.

27. A method of parking a vehicle, comprising the steps of:

driving the vehicle onto an inclined platform having a first end and a second end; and changing the distribution of weight supported by said platform without moving said vehicle to cause said platform to rotate in response to the force of gravity and to form a space beneath said device, wherein a second vehicle may be parked.

28. A method of parking a vehicle, comprising the steps of:

driving the vehicle onto an inclined platform having a first end and a second end; and changing the distribution of weight supported by said platform to cause said platform to rotate in response to the force of gravity and to form a space beneath said device, wherein a second vehicle may be parked, wherein the distribution of weight supported by said platform is changed by moving a weight along the length of said platform.

* * * * *